United States Patent [19]

Kelley

[11] 4,320,562

[45] Mar. 23, 1982

[54] NESTABLE CASKET

[76] Inventor: Robert J. Kelley, 3245 Stettinius Ave., Cincinnati, Ohio 45208

[21] Appl. No.: 159,159

[22] Filed: Jun. 13, 1980

[51] Int. Cl.[3] ..... A61G 17/00

[52] U.S. Cl. ..... 27/2; 27/7

[58] Field of Search ..... 27/2, 7, 14, 16–19

[56] References Cited

U.S. PATENT DOCUMENTS

| | | | |
|---|---|---|---|
| 2,811,768 | 11/1957 | Axelson | 27/17 X |
| 3,159,901 | 12/1964 | Harrington et al. | 27/7 |
| 3,172,183 | 3/1965 | Bogg | 27/7 |
| 3,353,238 | 11/1967 | Sieloff | 27/16 X |
| 3,545,055 | 12/1970 | Pare | 27/7 |

FOREIGN PATENT DOCUMENTS

| | | | |
|---|---|---|---|
| 2387644 | 12/1978 | France | 27/7 |
| 202931 | 3/1966 | Sweden | 27/2 |

*Primary Examiner*—John D. Yasko

*Attorney, Agent, or Firm*—Wood, Herron & Evans

[57] ABSTRACT

A three piece molded casket structure comprising a tub section, and head and foot lid sections. The tub section is structured so that plural tub sections can be nested one within another. The lid sections are structured so that plural lid sections can be nested one within another and, when inverted, stacked within the top tub section of a nested stack of tub sections. As many as five tub and two lid sections (enough for five complete caskets) may be stacked into a shipment package with sufficient space between the stacked tubs and lids to allow for storage of all components such as pillows, mattresses, and upholstering necessary to complete the five caskets. The stack of five is then no higher than the space now required and conventionally used to take a single casket to market. Each lid section also incorporates novel fasteners on the lid's inside face so that an upholstered interior can be easily attached to and detached from the lid.

11 Claims, 7 Drawing Figures

NESTABLE CASKET

This invention relates to caskets.

Historically, caskets or burial coffins were initially fabricated out of pineboards into a pine box. Subsequent casket development, and the desires of the consumer public, called for fancier or more ornate casket structures. These latter casket structures were fabricated of wood as well as metal. However, with the sturdier, more attractive casket came higher cost. And in this day and age there is a certain segment of the consumer public that does not wish to expend significant sums on burial of a deceased. Toward this end, less expensive caskets have been developed, and caskets are now in use which are fabricated or molded of plastic or fiberglass or the like.

One of the major cost problems associated with manufacture of caskets has been shipment of the caskets from the manufacturer to the user, e.g., the funeral home operator. Generally, caskets are shipped by simply stacking one on top another in a delivery vehicle. Since a casket is nothing more than an empty box, significant space is wasted in the delivery vehicle. With certain types of caskets becoming less and less expensive through molding techniques, the shipping costs create a higher and higher portion of the cost to the end user.

Accordingly, it has been the primary objective of this invention to provide a molded casket structure comprised of a tub section and two lid sections, the sections being structured so that plural tub sections can be nested one within another, and so that plural lid sections can be nested one within another, and so that the plural nested lid sections can be nested within the top tub section of a nested tub section stack. The lid sections are inverted when in nested relationship within the top tub of the nested tub sections. In this way, a series, e.g., four or five, of these three piece molded caskets of the same structure can be shipped in a package from within a space, i.e., with outside dimensions, not significantly greater than the space required for shipment of a single casket which is not nestable with others of its same structure. There is open space between the nested sections and particularly between the nested tubs and inverted lids which may be used for shipment of components, as for example mattresses, pillows, upholstery, necessary to complete the caskets. This nestable feature, of course, saves significant sums in connection with shipping costs when transporting molded caskets from manufacturer to end user.

Other objectives and advantages of this invention will be more apparent from the following detailed description taken in conjunction with the drawings in which:

FIG. 7 is a cross sectional view similar to FIG. 3 but showing two caskets in nested or shipping relation one within another.

Figures 1, 4, 5:
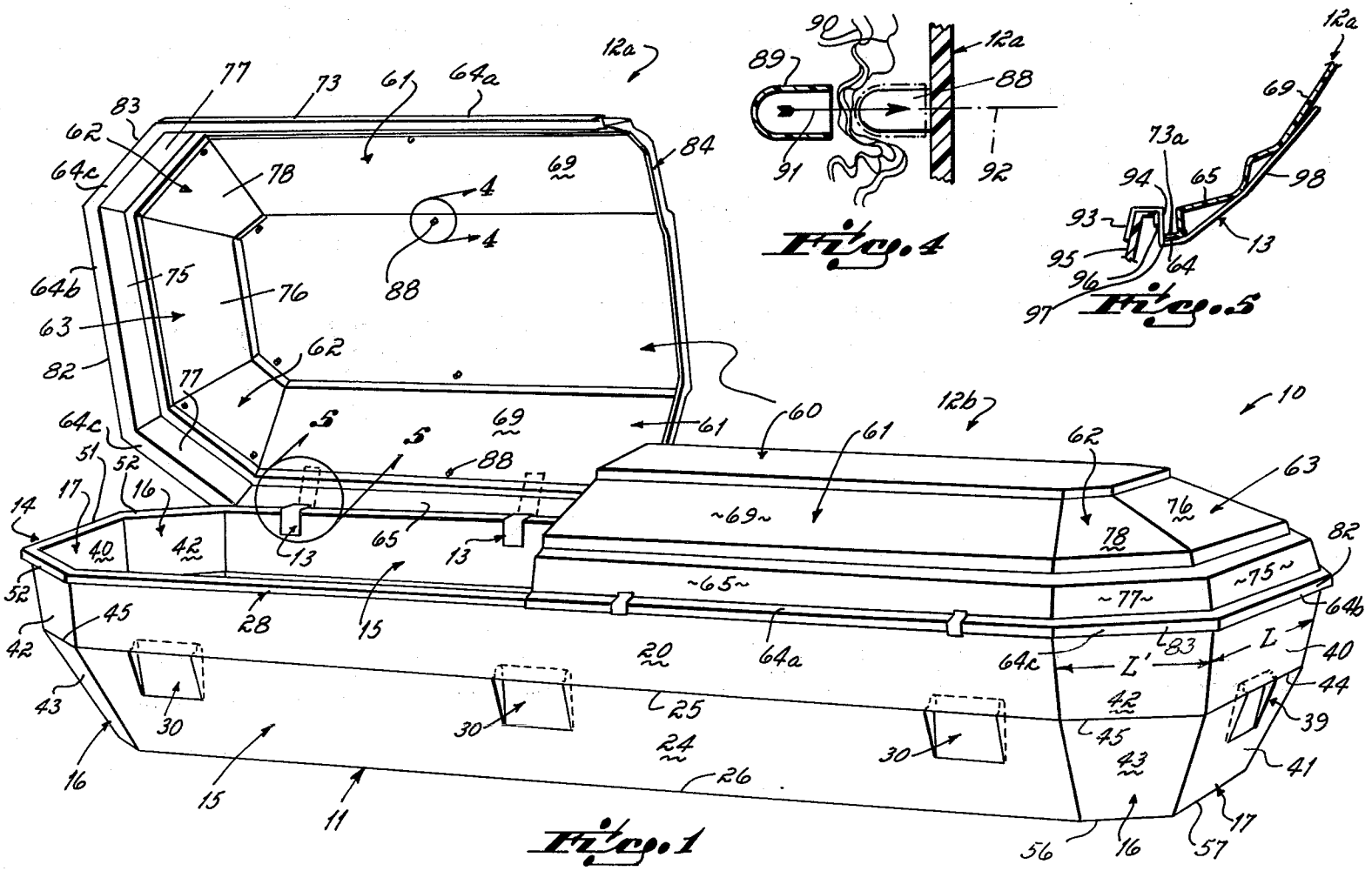
FIG. 1 is a perspective view of a molded casket formed in accord with the principles of this invention.
FIG. 4 is an enlarged view of the encircled portion 4—4 of FIG. 1.
FIG. 5 is an enlarged view of the encircled portion 5—5 of FIG. 1.
Figure 2:
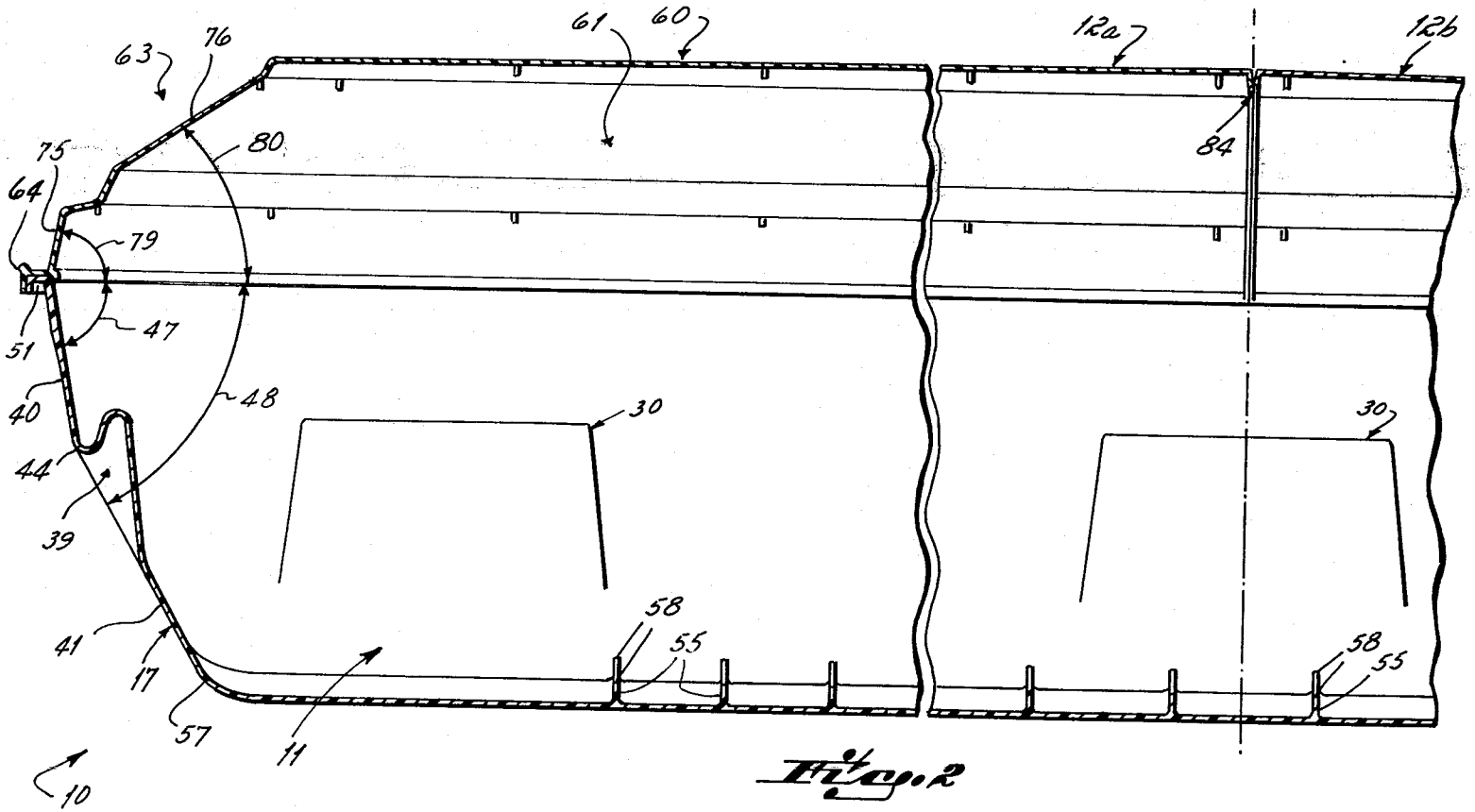
FIG. 2 is a cross sectional view taken along line 2—2 of FIG. 1, but with both lid sections closed.
Figure 3:
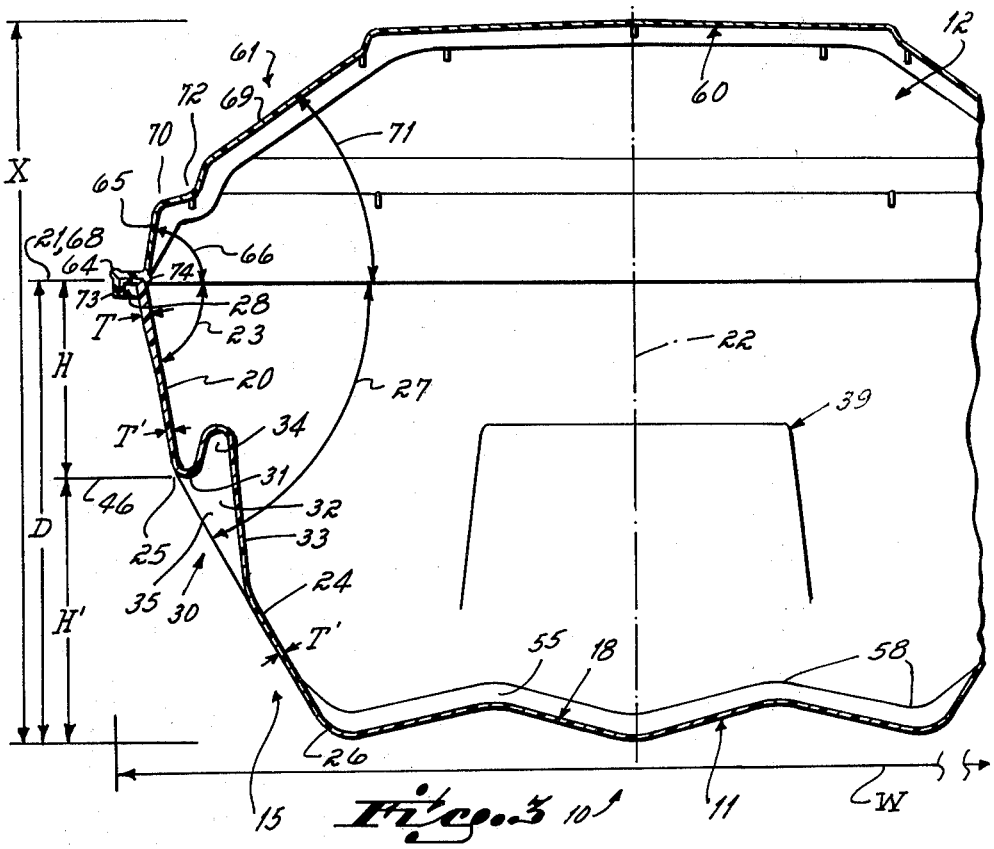
FIG. 3 is a cross sectional view taken along line 3—3 of FIG. 1.
Figure 4:
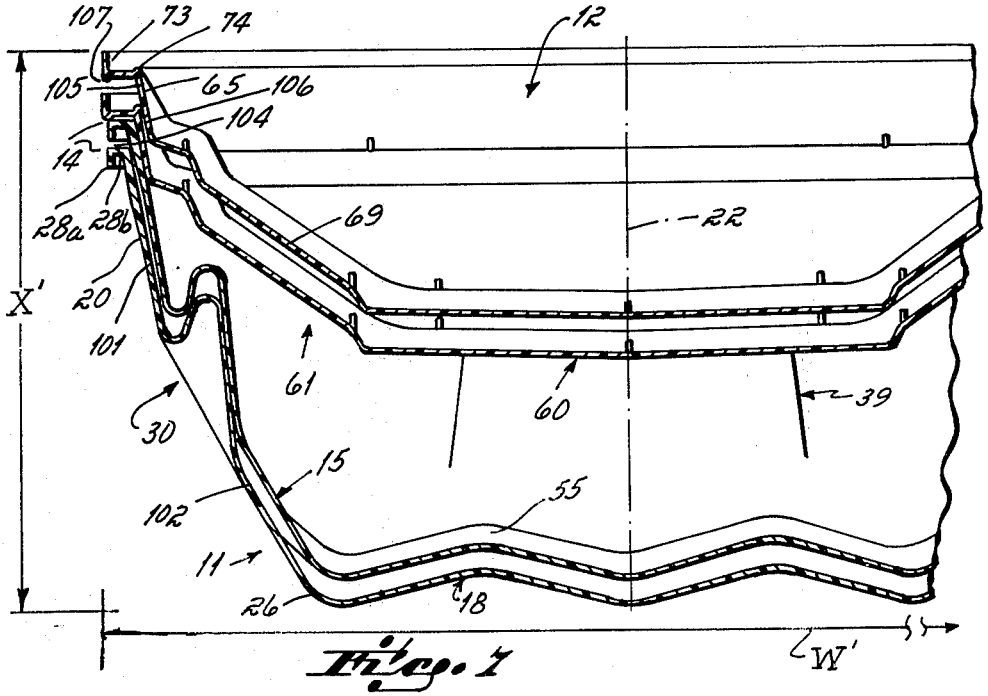

A casket 10 structured in accord with the principles of this invention is shown in FIGS. 1–3, the casket's primary structural features being illustrated in those figures. As shown, the casket 10 includes a tub section 11 and two half-lid sections 12, i.e., a head lid section **12*a* and a foot lid section 12*b*, for a total of three pieces 11, 12*a*, 12*b*. Note particularly neither half-lid section 12 is not positively connected to the tub section 11 by hinges or otherwise, although it is possible to show the head lid section 12*a* in an open or casket display configuration for funeral home use (as illustrated in FIG. 1, and as described in greater detail below) through use of special display brackets 13. The casket's tub section 11 and two lid sections 12 are preferably molded of a fiberglass reinforced plastic resin. The use of molding techniques permits the casket 10** to be fabricated at economical costs.

Figure 6:
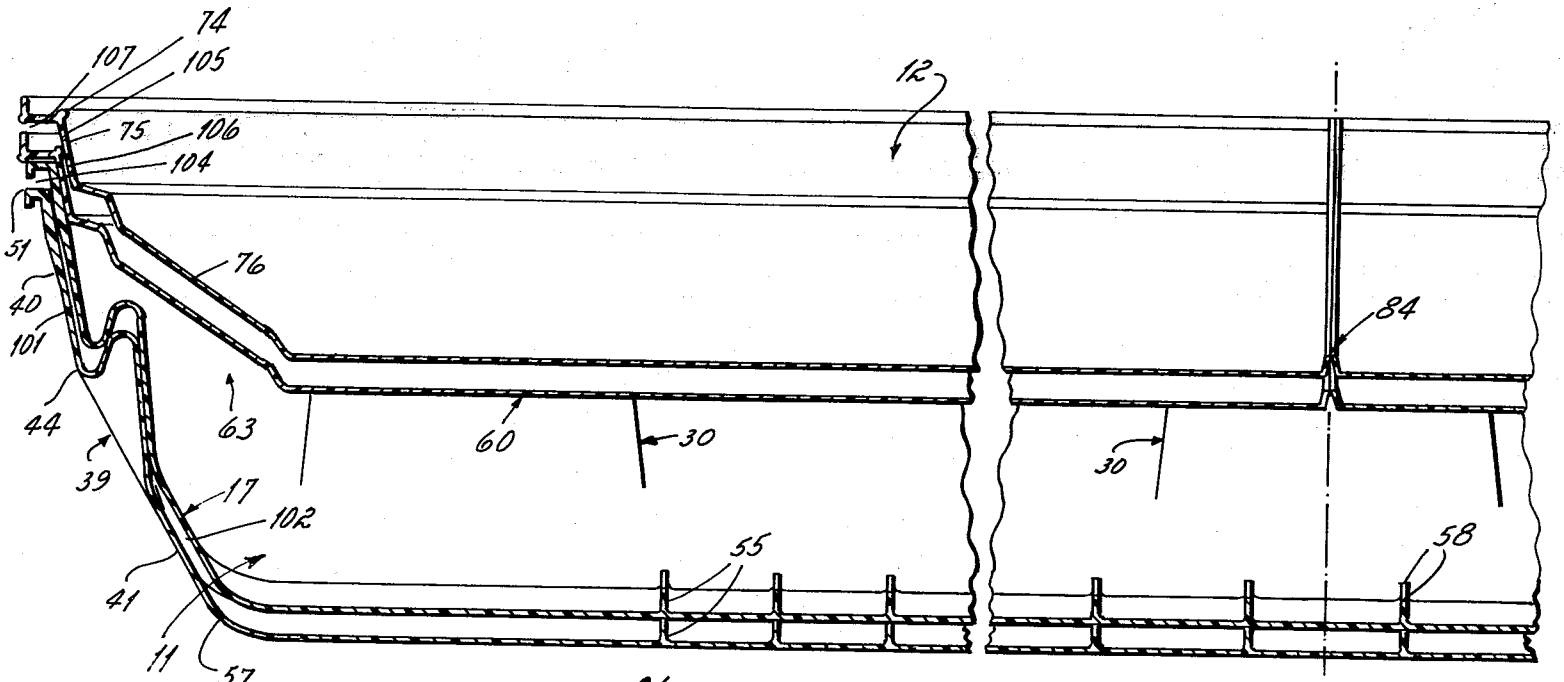
FIG. 6 is a cross sectional view similar to FIG. 2 but showing two caskets in nested or shipping relation one within another.

The tub section 11 of the casket is particularly illustrated in FIGS. 1–3. The tub section 11 is of a one piece molded configuration open only at the top or closure edge, the top of that tub section being defined by top closure edge periphery 14 located in phantom horizontal periphery plane 21. The tub section 11 is, of course, made up of side walls 15, corner walls 16, and end walls 17 that extend downwardly from the peripheral edge 14 and merge with floor or bottom wall 18. The novel configuration and structure of the side walls 15, corner walls 16, end walls 17 and floor 18 of the tub section 11 permit nesting of plural tub sections one with another as shown in FIGS. 6 and 7, and as described in greater detail below. More particularly, each tub side wall 15 includes a tub side panel 20 that extends downwardly and inwardly from the tub's peripheral edge 14 toward the tub's floor 18. Relative to a phantom horizontal plane 21 that passes through or includes the tub's peripheral side edge 14. An acute angle 23 is defined between the tub side panel 20 and that phantom horizontal plane 21. The tub side panel 20 terminates at a vertical height H from the top edge 14 which is not greater than about one-half the depth D of the tub section 11 as measured in the tub section's center longitudinal plane 22. Each tub side wall 15 also comprises a side transition panel 24 which extends downwardly and inwardly from the bottom edge 25 of the tub's side panel 20 until it merges as at 26 with the tub's floor 18. Note particularly, that the angle 27 which this side transition panel 24 makes with the phantom peripheral edge plane 21 is substantially less than the angle 23 which the tub's side panel 20 makes with that same plane 21, all as shown in FIG. 3. Note further that the vertical height H′ of this side transition panel 24 is greater than about one-half of depth D of the tub section 11, and therefore is greater than the vertical height H of the tub side panel 20.

The top edge section of the tub's peripheral edge 14, as shown in FIGS. 3 and 7, is provided with a right angle flange 28 that extends outwardly and downwardly relative to that edge. This right angle flange 28, which includes horizontal **28*a* and vertical 28*b* lips, cooperates with the lid sections 12 as described in greater detail below, and also serves to provide some degree of rigidity to the tub's peripheral edge 14. Note particularly that the thickness T of the tub's side panel 20 adjacent the top edge 14 is substantially greater than the thickness T′ of the rest of the tub's side panel 20, and is substantially greater than the thickness T′ of the tub's side transition panel 24. This thickness difference in panels 20, 24** provides reinforcement and rigidity to those panels.

The tub section's side panel 20 and the side transition panel 24 cooperate to define hand grips 30 recessed into the tub section's interior as shown in FIGS. 1 and 3. These hand grips 30, there being three shown in each side wall 15, each provide a curved hand grip edge 31 which is coextensive with the transition edge 25 defined by the side panel 20 where it merges into the side transition panel 24. This structural relation of the hand grip's gripping edge 31 relative to what, in effect, is the bottom edge of the side panel 20 tends to provide rigidity and reinforcement to the hand grips 30 and to the side wall 15 when the tub section 11 is lifted by, e.g., pallbearers. Each recessed hand grip 30 is comprised of an inner cavity 32 defined by an inner panel 33 interiorly of the side panel 20 and side transition panel 24, i.e., interiorly of the tub's side wall 15, which inner cavity panel 33 traverses or extends over both the side panel and the side transition panel when the casket is viewed in side view or end view. This inner cavity panel 33 cooperates with side panel 20 to define a pocket 34 that extends above the transition line 25 of the tub section's side wall 15, the pocket 34 being provided for a user's fingers. Each hand grip cavity 32 is closed to the tub's interior by cavity end panels 35.

Both of the tub's end walls 17 are identical in basic structure configuration to the tub's side walls 15, panel 40, 41 length L and number of recessed hand grips 39 being the primary differences. Also, all the tub's corner walls 16 are identical in basic structural configuration to the tub's side walls 15 except no recessed hand grips are provided in the corner walls and, of course, the panel 42, 43 length L' is reduced. More specifically, each of the tub's end walls 17 comprises an end panel 40 and an end transition panel 41, and each of the tub's corner walls 16 comprises a corner panel 42 and a corner transition panel 43, these panels 40–43 all being of a height H and H', respectively, identical to the height H and H' of the tub's side panels 20 and the tub's side transition panels 24, thereby providing a transition corner line between the tub's side, corner and end panels. This structure establishes end transition edges 44 and corner transition edges 45 which are in the same phantom horizontal plane 46 as the side transition edges 25, this transition plane 46 being parallel to but spaced from the periphery plane 21 defined by the tub's section peripheral edge 14. Also angles 47, 48 defined by end panels 40 and end transition panels 41, respectively, with the phantom horizontal edge plane 21 are the same as angles 23, 27, respectively, for side panels 20 and side transition panels 24 relative to plane 21. The analagous angle (not shown) for corner panels 42 and corner transition panels 43 are likewise the same as angle 23, 27. Each of the tub's end walls 17 and tub's corner walls 16 also includes an outwardly and downwardly extending right angle flange 51, 52, respectively, attached to the tub section's top edge 14, the flanges configuration and size being the same as that used for the side walls' flanges 28. Further, the tub's end walls 17 are each provided with a recessed hand grip 39 of the same structural and functional characteristics as the recessed hand grips 30 provided in the tub's side walls 15.

The tub's floor 18 is undulated in traverse cross section as shown in FIG. 3, and is provided with a series of cross ribs 55 which follow that undulation as shown in FIGS. 2 and 3. In other words, the height of these cross reinforcing ribs 55 is the same acros the entire width of the floor so that the top edges 58 of those ribs is also undulating and generally parallel to the undulating floor as shown in FIG. 3. The cross ribs 55 are generally normal to the center longitudinal plane 22 of the casket. Since the tub section 11 is of a one piece molded configuration, the floor 18 is formed integral at corner edges 26, 56, 57, respectively, with the tub's side walls 15, corner walls 16, and end walls 17.

The two lid sections **12*a*, 12*b* for the casket are of equal lengths, and are identical in basic structural configuration. With respect to the foot lid section 12*b*, as shown in FIGS. 1–3, it is of a generally domed shaped configuration comprised of top wall 60, side walls 61, corner walls 62, and end walls 63. The side walls 61, corner walls 62 and end walls 63 terminate in a peripheral closure edge 64 which, when the foot lid section 12*b* is oriented in closure position with the tub section 11, is generally coexistensive with the peripheral edge 14 of the tub section, see FIGS. 2 and 3. Each side wall 61 of the foot lid section 12*b* includes a side panel 65 which extends upwardly and inwardly from the peripheral edge 64 of that lid section. The angle 66 which that side panel 65 defines with a phantom horizontal edge plane 68 that includes the section's peripheral edge 64 is about equal to, but in no case greater than, and may be substantially less than, the angles 23, 47 defined by the tub section's side 20, corner 42, and end 40 panels with their related horizontal phantom planes 21. This permits lid section 12*b*, when inverted, to be nested within a tub section 11, as described in further detail below. Each side wall 61 of the lid section 12*b* also includes a side transition panel 69 which extends upwardly and inwardly from the top edge 70 of the side panel 65 and connects that side panel with the cover wall 60 of the lid section. The angle 71 which that side transition panel 69 makes with the phantom horizontal peripheral edge plane 68 is substantially less than the angle 66 which the side panel 65 makes with that same phantom horizontal plane. An inwardly oriented or depressed rib 72 is provided between the side panel 65 and the side transition panel 69**.

Each lid section 12, as shown in foot lid section **12*b*, also includes an outwardly and downwardly depending right angle flange 73 attached to side walls 61 at the peripheral edge 64 thereof. This right angle flange 73 is of a width and depth that permits it to mate with the adjacent outwardly and downwardly depending flange 28 on the tub section 11 when the lid 12*b* and tub 11 are joined in closure relation as shown in FIGS. 2 and 3. When so joined, the cooperating flanges 73, 28 prevent a casual observer from viewing the casket's interior. Further, and importantly relative to the nestability feature discussed in greater detail below, an inwardly oriented tongue 74 extends inwardly along the peripheral edge 64 of each lid section 12. This inwardly directed tongue 74 functions to aid in preventing the sticking of lid sections 12 nested one within another when plural caskets are in the nesting position shown in FIGS. 6 and 7** as is described in greater detail below.

Each lid section 12, as shown in foot lid section **12*b*, also includes an end wall 63 and corner walls 62. The structural relation of the end wall 63 and corner walls 62 relative to the lid section's peripheral edge 64 and cover wall 60 is the same as the structural relation of the lid section's walls 61 with those respective structural components as just described. In other words, the lid section's end panel 75 and end transition panel 76, and the lid section's corner panel 77 and corner transition panel 78, establish the same angular relations 79, 80 relative to phantom horizontal plane 68 which include the respective end and corner peripheral edge portions 64***b*, 64*c* as is the case with the angular relations 66, 71 between the side panel 65 and side transition panel 69 relative to the horizontal plane 68 which includes the side peripheral edge portion 64*a*. Further in this regard, the end wall 63 and corner walls 62 also each include a right angle flange 82, 83 respectively, which is sized and configured the same as the side walls' right angles 73, thereby providing a continuous outwardly and downwardly extending flange 73, 82, 83 from one end to the other. Each lid section 12 also includes an open end 84 adapted to mate with an adjacent open end of the other lid section. This open end is provided with an end flange 85 extending from one side edge 64*a* of the lid section 12 to the other. These end flanges 85 are adapted to cooperate with one another when both cover sections 12*a*, 12*b* are in closure relation with the tub section 11 so as to provide a continuous lid or cover 12 from one end of the tub section to the other, and so as to provide structural rigidity to the lid in the center or butt joint area 86 of the two lids one with another.

Both lid sections 12*a*, 12*b* include a series of posts 88 molded integral therewith as shown in FIGS. 1 and 4. These posts 88 cooperate with closed end caps 89 for the purpose of retaining or attaching an upholstered interior 90 directly to the inside of the lid section. The inside diameter of each cap 89 is sized relative to the outside diameter of its associated post 88 so that, when the upholstered interior 90 is interposed between the two and the cap thereafter inserted on the post as shown by the direction arrow 91, frictional contact between the component parts will retain the upholstered interior in display position. Note particularly the posts 88 are formed or molded integral with the respective panel of the lid section 12*a* on which it is mounted, and that all such retainer posts are provided with an axis 92 normal to the cover wall 60.

The casket 10 assembly of this invention also includes generally S-shaped display brackets 13 by which the head lid section 12*a* and/or the foot lid section 12*b* may be retained in open or display position relative to the tub section 11, see FIGS. 1 and 5. Such separate brackets 13 are required because, as earlier mentioned, neither of the cover sections 12*a*, 12*b* is permanently attached, e.g., by hinges, to the tub section 11. In cross sectional configuration, each of the S-shaped brackets 13 includes front 93 and middle 94 legs sized to frictionally contact the inside surface 95 of the tub section's side panel 20 and the outside surface 96 of the downwardly depending web 28*b* on the peripheral flange 28 as shown in FIG. 5. Each of the brackets 13 also includes an extended length display arm 98 angled upwardly from beneath the tub section's peripheral edge plane 21 to substantially above that peripheral edge plane. This extended length arm 98, along with the bracket's middle leg 94 that extends substantially below the tub section's peripheral edge plane 21, defines a seat area 97. The seats 97 of adjacent brackets 13 are of sufficient depth so that when lid section 12*a* is rested on the brackets' arms 98 the downwardly depending web 73*a* of the side flange 73 on that lid section 12*a* will be trapped therein all as shown in FIG. 5. This, of course, provides a very simple display bracket assembly by which the head lid section 12*a* and/or foot lid section 12*b* can be easily oriented in the display position shown in FIG. 1 as desired by the user.

Use of the casket 10 of this invention for purposes of shipping or the like from manufacturer to distributor or end user, or from distributor to end user, is illustrated in FIGS. 6 and 7. As shown in those figures, plural caskets 10 fabricated in accord with the principles of this invention, and of the same structural configurations and dimensions, may be nested inside one another to the extent that four or five caskets in nesting configuration will not take up any greater spece than is now conventionally used (twenty-six inches) to ship a single casket. In this regard, note the width dimension W of a single closed casket 10 (shown in FIG. 3) is the same as the width dimension W′ of two nested caskets (shown in FIG. 7) and note that the height dimension X of the single closed casket is substantially greater than the height dimension X′ of two nested caskets. In other words, the shipping space required for five nested caskets is not greater than the shipping space required for a single casket in normal closure position. More particularly in this regard, and with reference to FIGS. 6 and 7, tub sections 11 are nested one within another initially. The reinforcing cross ribs 55 on the floors 18 of the caskets tends to maintain gaps 101, 102 between the side 15, corner 16 and end 17 walls, and gap 103 between the floors 18 of the nested tub sections. Also, depending webs 28*b* of the tub sections' flanges 28 are spaced one from another as illustrated by finger access gap 104, see FIG. 7. This structural configuration allows nested tub sections 11 to be relatively easily separated one from another because of the gaps 101–104 when it is desired to remove the tub sections from the nested position. Further, and importantly, as illustrated in FIGS. 6 and 7 the caskets' lid sections 12*a*, 12*b* are nested interiorly of the top tub section of a tub section nest when those lid sections are inverted relative to the normal casket closure position shown in FIGS. 2 and 3. The inverted lid sections 12 are nested one within another and simply placed within the top tub section 11 in nesting relation. In this regard, the inwardly extending annular tongue 74 formed at the lid sections' peripheral edges 64 cooperates with the outer faces 105 of the lid sections' side panels 65, corner panels 77 and end panels 75 to maintain a slight gap 106 between those panels one with another and, also, to maintain a finger access gap 107 between the lid sections' depending flanges 73, 82, 83. The gap 106 between the lid sections' panels 65, 77, 75 prevents sticking of one nested lid section with another, and the gap 107 between nested lid sections' flanges 73, 82, 83 permits finger access beneath those flanges to separate or lift out the lid sections one from another, and from the top tub section.

In commercial practice, and in shipping nestable casket of this invention, five such caskets, for example, may be nested together into a single shipping bundle. The caskets' tub sections 11 and lid sections 12 would be nested together as shown. And the upholstered interiors 90 for the lid sections 12, and the display brackets 13, would be stored in the space between top tub section and the bottom lid sections 12*a*, 12*b* of the bundle on the floor 18 of that top tub section, thereby enclosing the upholstered interiors and brackets during shipment to prevent loss.

Having described in detail the preferred embodiment of my invention, what I desire to claim and protect by Letters Patent is:

1. A casket comprising, a tub section, said tub section having side walls and end walls structured and configured to permit nesting of similar tub sections one within another, and a lid section, said lid section comprising two substantially identical half lid sections, said lid section being shallower in depth than said tub section, said lid section being removable from normal closed casket configuration with said tub section, said lid section being structured and configured to permit nesting of similar lid sections one within another, and being so configured that, upon inversion of said lid section relative to said tub section, said lid section can be received in nesting relation substantially interiorly of said tub section, each of said tub section and said lid section comprising a peripheral closure edge, said lid section being supportable interiorly of said tub section in said nesting relation at said peripheral closure edge of said tub section, the peripheral closure edge of each of said tub and lid sections defining phantom edge planes which are substantially parallel one to another when said tub section and said lid section are in normal casket closed configuration, said tub section comprising side panels and end panels disposed adjacent said tub section's peripheral closure edge, said lid section also comprising side panels and end panels located adjacent said lid section's peripheral closure edge, said tub section side panels and end panels being inwardly tapered at an angle from said tub section peripheral closure edge, said lid section side panels and end panels being inwardly tapered from said lid section peripheral closure edge, and said lid section's side panels and end panels each being inwardly tapered at an angle with said lid section's phantom edge plane which is not less than the inwardly tapered angle defined by the adjacent one of each of said tub section's side panels and end panels with said tub section's phantom edge plane when said tub section and said lid section are in closure relation, and said tub section further comprising side transition panels and end transition panels, said lid section also comprising side transition panels and end transition panels, said tub section's transition panels each defining an inwardly tapered angle with said tub section's phantom edge plane which is greater than the inwardly tapered angle defined by respective adjacent side panels and end panels of said tub section, and said lid section's transition panels each defining an inwardly tapered angle with said lid section's phantom edge plane which is greater than that angle defined by respective adjacent side panels and end panels of said lid section.

2. A casket as set forth in claim 1, said tub section's side panels and side transition panels meeting at a transition edge line, said tub section further comprising at least one hand grip on each side thereof, said hand grip being provided with a grip edge located generally on said transition edge line, and said hand grip further including a finger cavity recess in said tub section defined behind that said side panel with which it is associated.

3. A casket as set forth in claim 1, said lid section further comprising a peripheral tongue extending inwardly from the peripheral closure edge of said lid section, said peripheral tongue of one lid section being adapted to cooperate with another lid section nested therein to aid in preventing the sticking of the other lid section within the one lid section when said lid sections are in nesting relation with one another.

4. A casket as set forth in claim 1, said tub section further comprising a floor having a series of cross ribs connected thereto on the inside face of said floor, the cross ribs of one tub section cooperating with the outside face of a floor of another tub section to aid in the preventing the sticking of the other tub section within the one tub section when said tub sections are in nesting relation with one another.

5. A casket as set forth in claim 1, each of said tub section and said lid section comprising a peripheral flange mounted to each of said respective sections, each of said flanges extending outwardly and downwardly relative to the peripheral closure edge defined by said respective sections, and said peripheral flanges cooperating to prevent viewing of the casket's interior when said casket is in the normal closed casket configuration.

6. A casket as set forth in claim 1, said tub section and each of said half lid sections being of a one-piece molded lid configuration.

7. A bundle of caskets comprising a plurality of tub sections nested one within the other and an equal number of lid sections nested one within the other, the nested lid sections being nested within the tub sections in an inverted condition, each of said tub sections having side walls and end walls structured and configured to permit nesting of similar tub sections one within another, and each of said lid sections comprising two substantially identical half lid sections, each of said lid sections being shallower in depth than said tub sections, said lid sections being removable from normal closed casket configuration with said tub sections, each of said tub sections and said lid sections comprising a peripheral closure edge, said lid sections being supportable interiorly of said tub sections in said nesting relation at said peripheral closure edge of said tub section, the peripheral closure edge of each of said tub and lid sections defining phantom edge planes which are substantially parallel one to another when a tub section and a lid section are in normal casket closed configuration, each of said tub sections comprising side panels and end panels disposed adjacent said tub sections' peripheral closure edge, each of said lid sections also comprising side panels and end panels located adjacent said lid sections' peripheral closure edge, said tub sections' side panels and end panels being inwardly tapered at an angle from said tub sections' peripheral closure edge, said lid sections' side panels and end panels being inwardly tapered from said lid section peripheral closure edge, and said lid sections' side panels and end panels each being inwardly tapered at an angle with said lid sections' phantom edge plane which is not less than the inwardly tapered angle defined by the adjacent one of each of said tub sections' side panels and end panels with said tub sections' phantom edge plane when said tub sections and said lid sections are in closure relation, and said tub sections further comprising side transition panels and end transition panels, and said lid sections also comprising side transition panels and end transition panels, said tub sections' transition panels each defining an inwardly tapered angle with said tub sections' phantom edge plane which is greater than the inwardly tapered angle defined by respective adjacent side panels and end panels of said tub sections, and said lid sections' transition panels each defining an inwardly tapered angle with said lid sections' phantom edge plane which is greater than that angle defined by respective adjacent side panels and end panels of said lid sections.

8. A display bracket for a casket, said bracket being structured to maintain a casket lid section in open display configuration with a casket tub section, said display bracket comprising a front leg and a middle leg connected together in generally U-shaped configuration, said legs beings adapted to be frictionally engaged over the top edge of said tub section for connecting said display bracket to said tub section, and an extended length display arm connected to said middle leg, said connection being located beneath the tub section's closure edge, said display arm being angled so that it extends upwardly from beneath said tub section's closure edge to substantially above said closure edge, and said middle leg and said display arm defining a seat disposed beneath said tub section's closure edge within which said lid section maybe retained in open display configuration, when said bracket is mounted on said tub section.

9. A casket assembly comprising a tub section and a lid section, said lid section being separable from said tub section, and a display bracket comprising a front let and a middle leg connected together in generally U-shaped configuration, said legs being adapted to be frictionally engaged over the top edge of said tub section for connecting said display bracket to said tub section, and an extended length display arm connected to said middle leg, said connection being located beneath the tub section's closure edge, said display arm being angled so that it extends upwardly from beneath said tub section's closure edge to substantially above said closure edge, and said middle leg and said display arm defining a seat disposed beneath said tub section's closure edge within which said lid section maybe retained in open display configuration, when said bracket is mounted on said tub section.

10. A casket lid of one piece molded configuration, said casket lid comprising a series of posts formed integral with said casket lid, and extending inwardly from the inside surface of said lid, and a series of caps for use with said posts, each cap being receivable in frictional engagement with a post when an upholstered interior is interposed between said cap and said posts, said cap connection with said post thereby retaining said upholstered interior in place with said casket lid.

11. A casket lid structure as set forth in claim 10, the axes of said post being oriented generally perpendicular to the closure edge plane defined by the closure edge of said casket lid.

* * * * *